US007748545B2

(12) United States Patent
Johnson

(10) Patent No.: US 7,748,545 B2
(45) Date of Patent: Jul. 6, 2010

(54) METHOD AND APPARATUS FOR RETAINING GAS CYLINDERS

(75) Inventor: Matthew Johnson, Anniston, AL (US)

(73) Assignee: Alabama Laser Technologies, Munford, AL (US)

( * ) Notice: Subject to any disclaimer, the term of this patent is extended or adjusted under 35 U.S.C. 154(b) by 718 days.

(21) Appl. No.: 11/437,908

(22) Filed: May 19, 2006

(65) Prior Publication Data

US 2007/0267370 A1 Nov. 22, 2007

(51) Int. Cl.
*A47G 29/00* (2006.01)

(52) U.S. Cl. ..... 211/78; 211/163; 312/135

(58) Field of Classification Search ..... 211/85.18, 211/85.19, 85.21, 85.22, 58, 70, 78, 163, 211/71.01, 60.1, 77; 248/131, 349.1, 521; 312/135, 125, 305; 108/103, 104, 139
See application file for complete search history.

(56) References Cited

U.S. PATENT DOCUMENTS 401,829 A * 4/1889 Hall ..... 211/77
452,216 A * 5/1891 Davnie ..... 248/97
456,728 A * 7/1891 Lamson ..... 312/135
505,320 A * 9/1893 Meadows ..... 211/64
663,046 A * 12/1900 Schaeffer ..... 211/163
1,325,585 A * 12/1919 Schmidt, Jr. ..... 312/296
1,586,826 A * 6/1926 Michelbach ..... 211/70
1,586,827 A * 6/1926 Michelbach ..... 211/70
1,759,140 A * 5/1930 Silberger ..... 211/77
2,317,064 A * 4/1943 Josephian ..... 280/1
2,950,893 A * 8/1960 McLarney et al. ..... 248/349.1
3,065,857 A * 11/1962 Sanders ..... 211/85.19
3,791,403 A * 2/1974 Folkerth ..... 137/343
3,981,405 A * 9/1976 Slack ..... 211/70
4,066,172 A * 1/1978 Howard ..... 211/78
4,899,968 A * 2/1990 Eaglin et al. ..... 248/131
5,074,421 A * 12/1991 Coulter ..... 211/78

* cited by examiner

*Primary Examiner*—Darnell Jayne
*Assistant Examiner*—Stanton L Krycinski
(74) *Attorney, Agent, or Firm*—Smith, Gambrell & Russell

(57) ABSTRACT

A storage and retention unit for gas cylinders is provided wherein a movable inner frame defines a plurality of cylinder receptacles which are indexed from an opening in a surrounding outer frame about an axis such that any cylinder within a receptacle is restrained by the outer frame and inner frame as it advances about the axis until the receptacle returns to the opening.

4 Claims, 2 Drawing Sheets

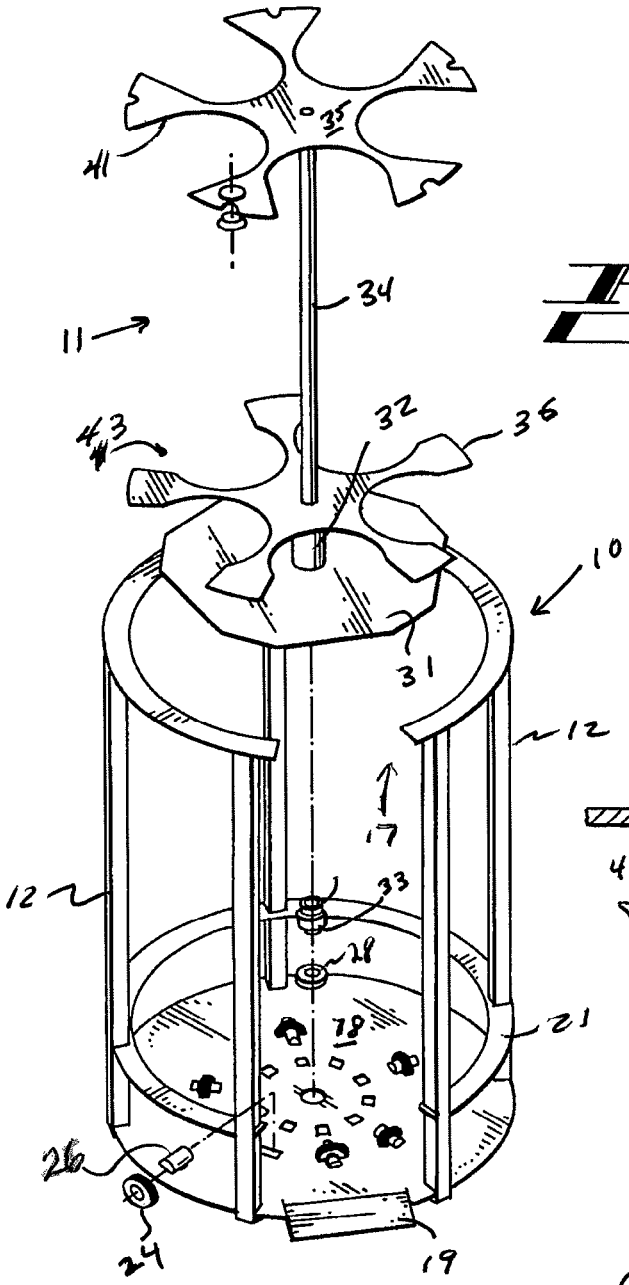
Fig. 5
Fig. 3
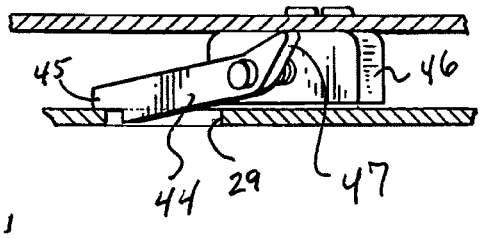
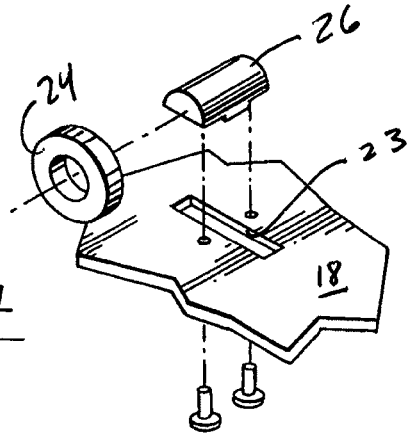
Fig. 4

METHOD AND APPARATUS FOR RETAINING GAS CYLINDERS

The present invention relates to the retention of gas cylinders and more particularly to the safe storage and retention of such cylinders. More particularly the present invention relates to storage and retention of groups of cylinders. In greater particularity the present invention relates to a carousel for storing and retrieving gas cylinders.

BACKGROUND OF THE INVENTION

Gas cylinders as referred to in this application are commonly used to hold various gases such as oxegen, nitrogen, and other gases used in industrial applications such as welding and the like. Typically, such cylinders are substantially longer than they are wide and are susceptible to falling over when resting on their bottom. The tops of such cylinders usually include the valve works by which the cylinders are filled and depleted. When such a cylinder is pressurized with a gas, a potentially hazardous situation can be created by improperly storing such cylinders. If the cylinders are stored upright as is typical and one of the cylinders topples over, damage to the cylinder top or casing can turn the cylinder into an uncontrolled projectile weighing over one hundred pounds and capable of severely damaging adjacent property and personnel. Accordingly, a need exists for a safe system for storing and retaining such cylinders.

Secondly, a need exists for storage of the cylinders which facilitates inventory reconciliation. By way of example, there is no way to visually distinguish empty cylinders from full cylinders and no way to quickly ascertain how many cylinders of a group of cylinders are full. Likewise it is difficult to determine which cylinder among a group of cylinders has been in inventory the longest. Therefore, a need exists for a better system of inventorying cylinders in storage.

SUMMARY OF THE INVENTION

It is an object of the present invention to provide a retainer for gas cylinders which will prevent such cylinders from toppling over and which will arrange the cylinders for rapid and easy deployment.

It is a further object of the invention to provide such a retainer which will facilitate use of the oldest cylinder in a group first.

It is a further object of the invention to improve the ability of a user of gas cylinders to control his inventory of such cylinders.

BRIEF DESCRIPTION OF THE DRAWINGS

Apparatus embodying the features of this invention are depicted in the accompanying drawings which form a portion of this disclosure and wherein:

FIG. 3 is a detailed view of an embodiment of the latch assembly

FIG. 4 is a detailed view of an embodiment of the support bearing assembly

FIG. 5 is an exploded view of the carousel.

DESCRIPTION OF A PREFERRED EMBODIMENT

Figure 1:
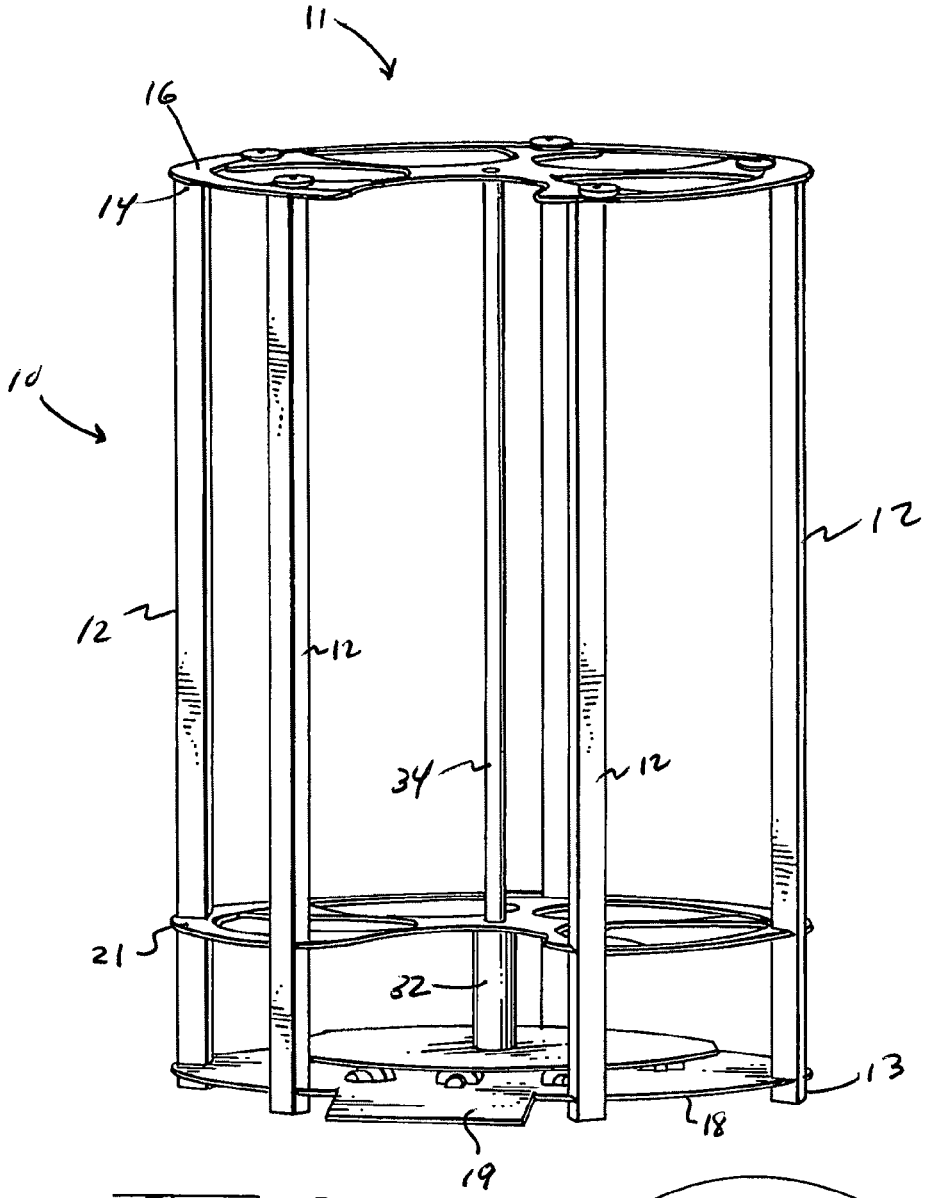
FIG. 1 is a perspective view of the gas cylinder carousel.
Figure 2:
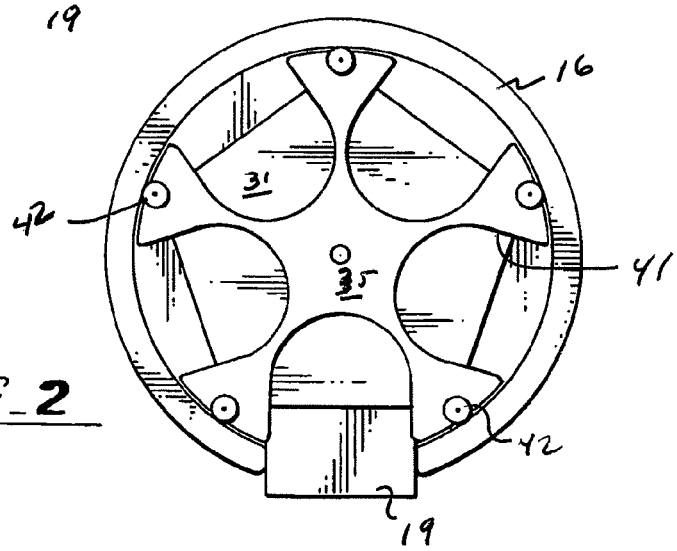
FIG. 2 is a top view of the gas cylinder carousel.

Referring to the drawings for a clearer understanding of the invention, it may be seen that the present invention is a specialized form of a carousel. In the embodiment shown in the figures an outer frame 10 supports an inner frame 11 and retains a plurality of gas cylinders, not shown, therein. Outer frame 10 includes a plurality of legs 12, one end 13 of each leg 12 rests on the floor or other surface on which the carousel is to be supported. The other end 14 of each leg 12 is affixed to a top ring 16, such as by welding or any other acceptable means of attachment. Top ring 16 is split to define an opening 17 intermediate two of the legs 12. A base plate 18 is interposed between legs 12 and affixed to each of them at a position slightly elevated relative to the underlying floor. A ramp 19 is affixed to base plate 18 directly under opening 17 and extends from base plate 18 to the floor. A lower ring 21 is affixed to legs 12 at a height above base plate 18 and like ring 16 is split to define an opening aligned beneath opening 17 and above ramp 19. Outer frame in this embodiment is made from metal, such as steel, however, the material used in outer frame need only have sufficient strength and rigidity to perform its functions, therefore other acceptable materials may include various composites or high strength plastics.

Base plate 18 has a plurality of slots 23 formed therein along and perpendicular to a plurality of spaced apart radians. Slots 23 each accommodate a weight supporting bearing 24 mounted on a bearing mount 26 affixed to base plate 18 such that bearing 24 is supported above the underlying floor and is freely rotatable about mount 26. A central aperture 27 is formed in base plate 18 and a flanged bearing 28 is press fit there into. A plurality of latch stops 29 are formed in base plate 18 around and spaced from aperture 27.

Movable inner frame 11 is supported on bearings 24 and 28. A rotating plate 31, which serves as a cylinder support member, is affixed to a spacer tube 32 with a bearing 33 affixed into a lower end thereof. Bearing 33 mates with flanged bearing 28 and extends therein to. A center pole 34 is secured in the upper end of spacer tube 33 and has an upper end affixed to the center of a cylinder holding plate 35, thereby defining the central axis about which inner frame 11 rotates. A bottom cylinder holding plate 36 is affixed to spacer tube 33 and center pole 34 at the same height as bottom ring 21.

Cylinder holding plate 35 is circular, but a plurality of U shaped recesses 41 are spaced about the circumference of plate 35. Recesses 41 are sized to receive the body of a gas cylinder therein. In the illustrated embodiment, there are five such recesses 41, however the number of recesses is a matter of choice based on the number of cylinders to be stored in one carousel. The carousel can be appropriately sized to yield more recesses, the recesses may be extended to accommodate an additional cylinder and other variations may be employed. Intermediate the recesses 41, plate 35 extends outwardly toward top ring 16 and carries a set of rollers 42 which engage ring 16 and holds the plate 35 in spaced relation to ring 16. Bottom cylinder holding plate 36 also is circular and has a series of cut-outs 43 which are vertically aligned with recesses 41. Cut-outs 43 are appropriately sized to receive a cylinder body therein, such that recesses 41 and cut-outs 43 form a cylinder receptacle within inner frame 11, with the bottom of the cylinder resting on rotating plate 31 and the body of the cylinder received in the cut-outs and recesses.

A latch lever 44 is pivotally mounted to a bracket 46 affixed to the bottom of plate 31 at a distance from spacer tube 32 equal to the distance from the bearing 28 to the latch stops 29. Lever 44 has a free end 45 and a pivot end 47. In the illustrated embodiment free end 45 rests on base plate 18 due to gravity. The latch stops 29 are actually apertures in base plate 18 which are sized such that free end 45 drops into the apertures as inner frame 11 is rotated. Rotation of inner frame 11 in a direction from free end 45 toward pivot end 47 withdraws the free end from the aperture stop 29, however rotation in the opposite direction urges free end 45 against the portion of the base plate 18 defining the aperture stop 29 arresting the rotation, thus the lever and aperture stop form an indexing latch that allows rotation of the inner frame only in one direction. The structure illustrated is but exemplary of one way to form an indexing latch. Clearly, spring loaded latch mechanisms may be employed and mounted to engage stops on either base plate 18 or rotating plate 31. Likewise, one way cam followers can be used to create an indexing latch to limit rotation of inner frame 11 to a single direction. In the preferred embodiment, and in any alternative embodiments the indexing latch will have the latch stops 29 positioned such that rotation of frame 11 from one stop to the next will move the cylinder receptacles defined by recess 41 and cutout 43 into vertical alignment with one of the support bearings 26, such that the bottom of rotating plate is supported on bearing 26 directly beneath the position that a gas cylinder would rest on rotating plate 31. It will be noted in the Figures that one such bearing 26 is located adjacent ramp 19 and centered on openings 17 and 22. The latch stops 29 are spaced such that alternating stops place one of the gas cylinder receptacles into alignment with ramp 19 and openings 17 and 22 such that gas cylinders can be loaded into or removed from the receptacle. The remaining stops position frame 11 such that no receptacle is aligned with ramp 19 or openings 17 and 22, such that no cylinders may be loaded or removed from the receptacles.

It should be understood from the foregoing that only one receptacle at a time may be aligned with opening 17 and that inner frame 11 may be advanced in only one direction, thus once a cylinder is loaded into a receptacle the frame must rotate 360 degrees before that cylinder can be removed, thus for each subsequent cylinder loaded into the frame, the first loaded cylinder will precede to the opening. In this manner the first loaded cylinder will always be the first cylinder available for removal from the frame thus facilitating inventory control to the extent that the "oldest" cylinder will become the first available for use. Further, upon loading a cylinder in any receptacle rotating the inner frame to the next stop secures all cylinders within the receptacles of inner frame 11 and the rings of outer frame 10.

It may be readily understood that the carousel has a much more stable height to bottom area ratio than an individual gas cylinder and the weight of the combined cylinders with this carousel renders the carousel and retained cylinders virtually impervious to tipping in the normal course of events. Ramp 19 facilitates transferring the cylinders into or out of the carousel. If empty cylinders are to be stored in the same carousel as cylinders containing usable gas, then the cylinder or a portion of the inner frame near the cylinder can be marked to indicate that the cylinder is empty. Accordingly the user can quickly look at the carousel and tell empty from usable cylinders.

While I have presented only one embodiment of the invention, the invention is not so limited but rather is intended to encompass the full scope of the appended claims.

What I claim is:

1. An apparatus for retaining elongated gas cylinders comprising:

a. a stationary outer frame including an upper annular ring b. a movable circular inner frame mounted within said outer frame for rotation about a central axis, said inner frame defining a plurality of gas cylinder receptacles opening outwardly relative to said central axis and including a horizontally extending upper plate wherein said upper plate extends outwardly intermediate said receptacles toward said upper ring and carries a set of rollers which engage said upper ring and hold said upper plate in spaced relation to said upper ring, at least one vertical member connecting said upper plate to a cylinder support member with a plurality of bearings supporting said cylinder support member; wherein said stationary outer frame defines an opening for ingress and egress of said cylinders into one of said gas cylinder receptacles only when said receptacle is aligned with said opening; and a latch coupling said movable inner frame and said stationary outer frame and limiting rotation of said inner frame to a first direction about said central axis and wherein said latch aligns at least one of said cylinder receptacles of said inner frame over at least one of said supporting bearings.

2. Apparatus as defined in claim 1 wherein said latch comprises a pivotally mounted lever having a free end movable between a normal position and a displaced position and at least one stop positioned to abut said free end of said lever when said inner frame is urged in a direction opposite to said first direction.

3. Apparatus as defined in claim 1 wherein said inner frame is selectively movable from an access position wherein one of said gas cylinder receptacles is aligned with said opening to a closed latched position where none of said plurality of gas cylinder receptacles is aligned with said opening.

4. Apparatus as defined in claim 3 wherein said latch comprises a pivotally mounted lever having a free end movable between a normal position and a displaced position and at least one stop positioned to abut said free end of said lever when said inner frame is urged in a direction opposite to said first direction.

* * * * *